US009496629B2

(12) United States Patent
Arai et al.

(10) Patent No.: US 9,496,629 B2
(45) Date of Patent: Nov. 15, 2016

(54) STRUCTURE OF SOCKET CONTACT

(71) Applicant: SMK Corporation, Tokyo (JP)

(72) Inventors: Atsushi Arai, Toyama (JP); Akiko Honda, Toyama (JP); Tetsuya Takagi, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/825,179

(22) Filed: Aug. 13, 2015

(65) Prior Publication Data

US 2016/0134053 A1 May 12, 2016

(30) Foreign Application Priority Data

Nov. 11, 2014 (JP) ..... 2014-228969

(51) Int. Cl.
*H01R 4/48* (2006.01)
*H01R 11/12* (2006.01)

(52) U.S. Cl.
CPC ..... *H01R 4/4827* (2013.01); *H01R 11/12* (2013.01)

(58) Field of Classification Search
USPC ..... 439/851, 852, 843, 730, 310
See application file for complete search history.

(56) References Cited

U.S. PATENT DOCUMENTS 4,408,815 A * 10/1983 Apicelli ..... H01R 4/48 439/387
5,106,329 A * 4/1992 Maeshima ..... H01R 13/111 439/851
5,769,673 A * 6/1998 Ohta ..... H01R 13/11 439/852
5,951,314 A * 9/1999 Durand-Cochet ... H01R 13/187 439/252
6,106,310 A * 8/2000 Davis ..... H01R 4/26 439/92
6,186,840 B1 * 2/2001 Geltsch ..... H01R 13/18 439/748
6,464,512 B2 * 10/2002 Morita ..... H01M 2/1055 439/66
6,565,396 B2 * 5/2003 Saka ..... H01R 13/11 439/491
7,896,712 B2 * 3/2011 Cecil ..... H01R 4/20 439/523
9,318,831 B2 * 4/2016 Yamada ..... H01R 13/2442

FOREIGN PATENT DOCUMENTS

JP H9-245862 A 9/1997

* cited by examiner

*Primary Examiner* — Alexander Gilman

(57) ABSTRACT

A structure of a socket contact that can establish connection with high connection reliability just by inserting core wire of a cable is provided. In the structure of a socket contact for connecting a core wire of a cable by insertion thereof, the socket contact includes a terminal contact for establishing electric connection with the core wire, and an elastic contact. The terminal contact has a contact portion for coming into contact with a side part of the core wire, and regulators erected on both sides of the contact portion in a width direction. The elastic contact has a retainer and a pusher for the core wire that are opposite to the contact portion of the terminal contact.

5 Claims, 7 Drawing Sheets

STRUCTURE OF SOCKET CONTACT

CROSS REFERENCE TO RELATED APPLICATION

The contents of the following Japanese patent application are incorporated herein by reference, NO. 2014-228969 filed on Nov. 11, 2014.

FIELD

The present invention relates to a structure of a socket contact for connecting a core wire of a cable.

BACKGROUND

For example, to connect a power cable of a power conditioner for a solar system or the like, a method is adopted in which a round contact is crimped to a core wire of the cable and then secured to a terminal board with a screw.

This method requires a large number of man-hours when making the connection in the field, and also tends to cause trouble owing to faulty screwing.

Patent Literature 1 discloses a terminal board into which core wires of cables are each inserted to establish connection at two portions i.e. a catching portion and a wedge portion.

However, in the structure of the cable connection disclosed in the Patent Literature 1, the connection is established just by elastic restoring forces of the catching portion and wedge portion. Thus, in a case where the core wire of a cable is stranded wire made from a plurality of solid wires, for example, the connection lacks stability.

CITATION LIST

Patent Literature

Patent Literature 1: Japanese Patent Application Laid-Open No. Hei. 9-245862

SUMMARY

Technical Problem

An object of the present invention is to provide a structure of a socket contact that can establish connection with high contact reliability just by inserting a core wire of a cable.

Solution to Problem

In the structure of a socket contact according to one aspect of the present invention, for connecting a core wire of a cable by insertion thereof, the socket contact includes a terminal contact for establishing electric connection with the core wire, and an elastic contact. The terminal contact has a contact portion for coming in contact with a side part of the core wire, and regulators erected on both sides of the contact portion in a width direction. The elastic contact has a retainer and a pusher for the core wire that are opposite to the contact portion of the terminal contact.

The terminal contact and the elastic contact may be formed into an integral unit.

It should be noted that when the terminal contact is made of a material of high conductivity, such as a copper plate, the terminal contact may not have sufficient elasticity required.

In one aspect of the present invention, the terminal contact and the elastic contact may be formed separately, and the elastic contact may have a housing engagement portion to be engaged in a housing in which the socket contact is fitted, and a terminal engagement portion to be engaged with the terminal contact.

According to one aspect of the present invention, the socket contact has the regulators erected on both the sides of the contact portion of the terminal contact in the width direction, in addition to the pusher and the retainer formed in the elastic contact to push a core wire of a cable to the terminal contact. Therefore, since the core wire is contained in a recessed portion formed by the contact portion and the regulators provided on both sides, it is possible to prevent the core wire from departing from the right position or from widening in a case, for example, in which the core wire is stranded wire, and thus resulting in good connection stability.

DESCRIPTION OF EMBODIMENTS

An example of the structure of a socket contact according to one embodiment of the present invention will be described with reference to the drawings, but the present invention is not limited thereto.

Figure 1A:
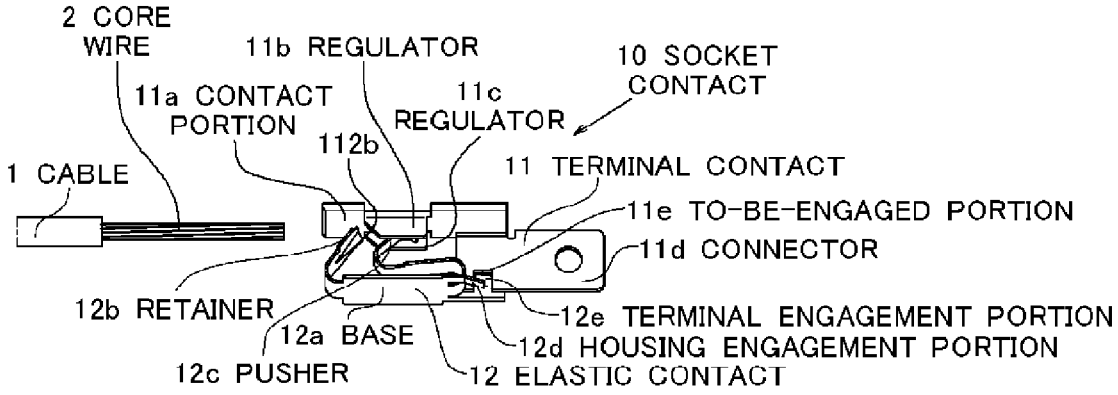
FIG. 1A is a diagram illustrating the structure of a socket contact.
Figure 1B:
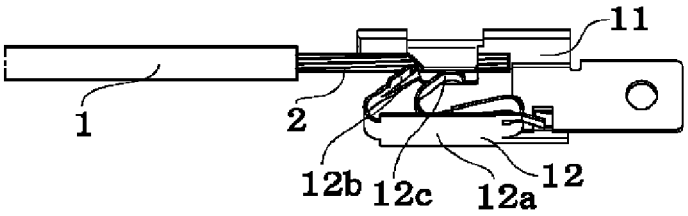
FIG. 1B is a diagram illustrating the connection structure in the state of inserting a core wire of a cable into the socket contact.
Figure 1C:
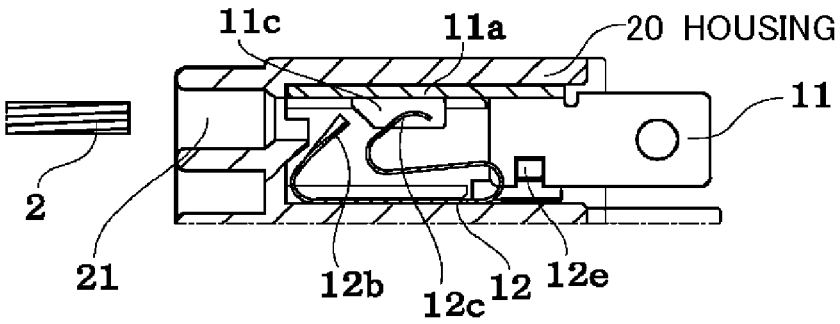
FIG. 1C is a diagram illustrating the structure of the socket contact fitted in a housing.
Figure 1D:
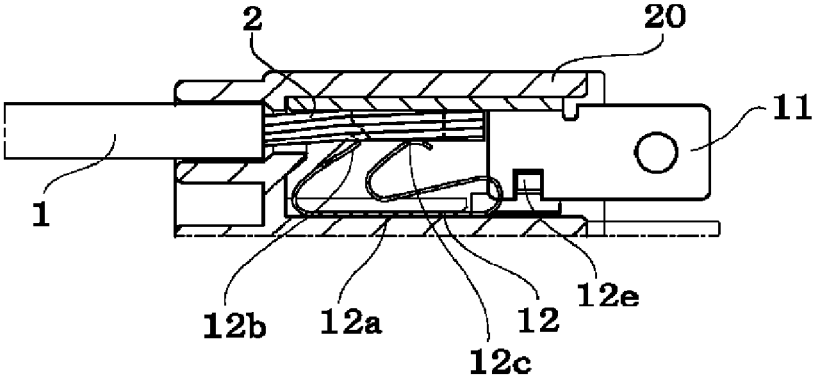
FIG. 1D is a diagram illustrating the state of inserting the core wire of the cable thereinto for connection.

FIGS. 1A and 1B illustrate only the socket contact, and FIGS. 1C and 1D illustrate the socket contact fitted into a housing.

Figure 2A:
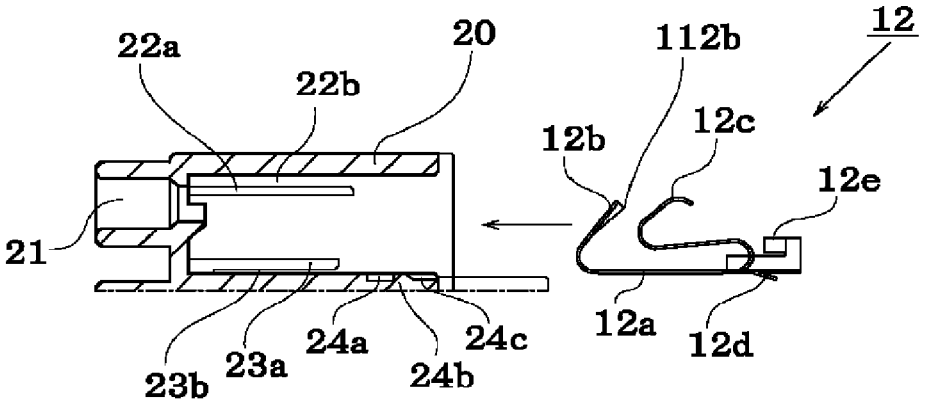
FIG. 2A is a diagram illustrating the state of fitting an elastic contact in the housing.
Figure 2B:
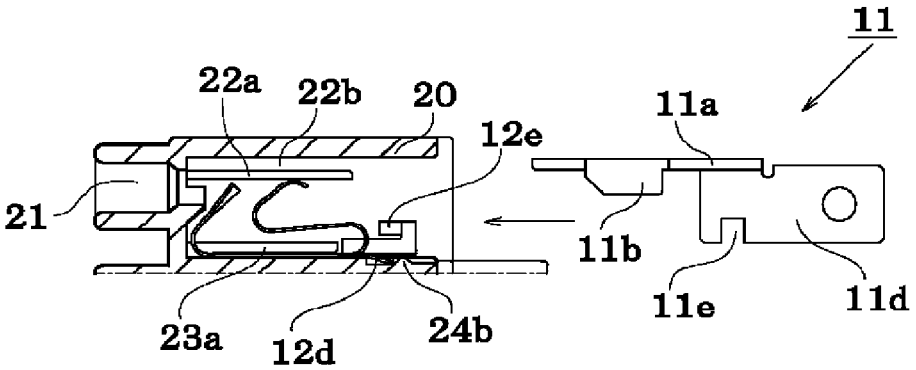
FIG. 2B is a diagram illustrating the state of fitting a terminal contact in the housing.
Figure 2C:
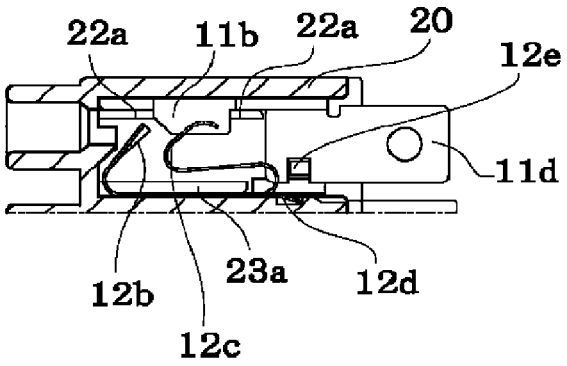
FIG. 2C is a diagram illustrating the structure of the socket contact fitted in the housing.
Figure 3A:
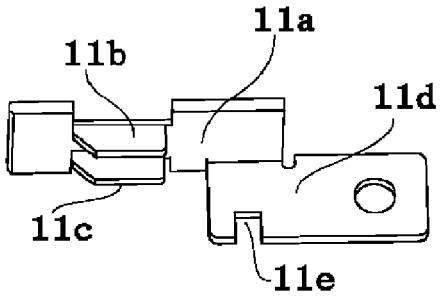
FIG. 3A is a diagram illustrating an example of the shape of the terminal contact.
Figure 3B:
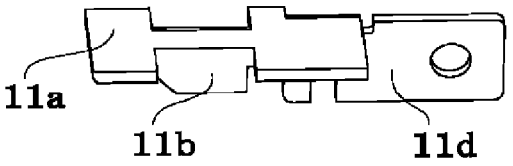
FIG. 3B is a diagram illustrating an example of the shape of the terminal contact.
Figure 3C:
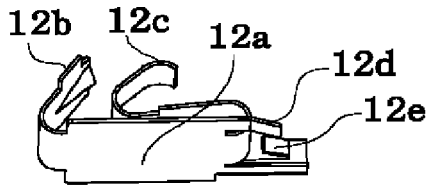
FIG. 3C is a diagram illustrating an example of the shape of the elastic contact.
Figure 3D:
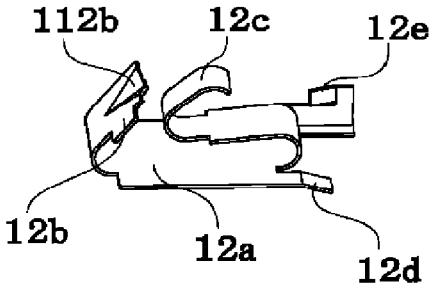
FIG. 3D is a diagram illustrating an example of the shape of the elastic contact.

FIGS. 2A to 2C illustrate an assembly procedure for the socket contact.

Figure 4A:
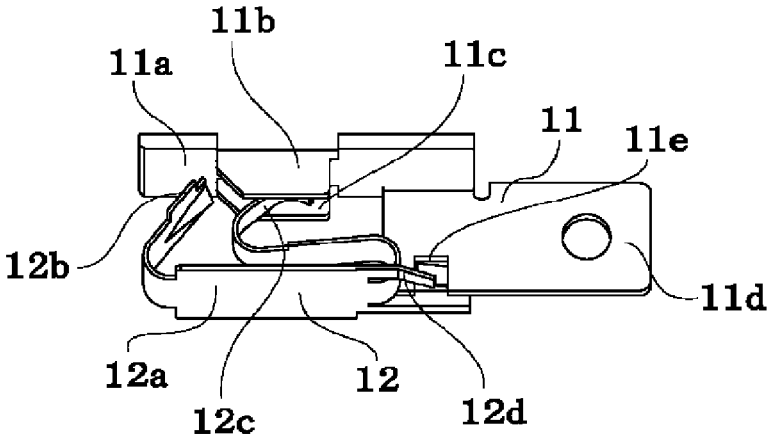
FIG. 4A is a diagram illustrating the state of attaching the elastic contact to the terminal contact.
Figure 4B:
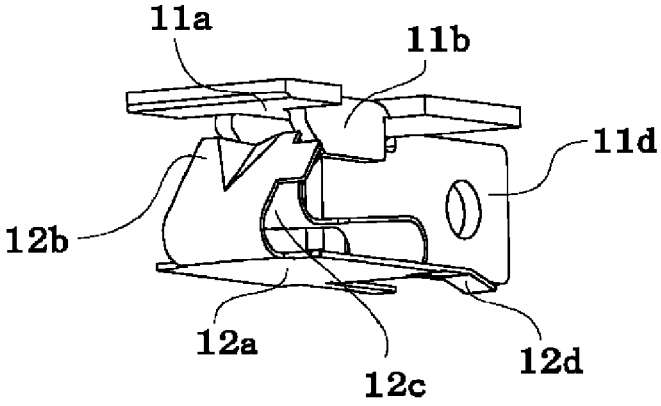
FIG. 4B is a diagram illustrating the state of attaching the elastic contact to the terminal contact.

FIGS. 3A to 3D illustrate examples of the shapes of parts, i.e. a terminal contact and an elastic contact constituting the socket contact, and FIGS. 4A and 4B are assembly diagrams thereof.

In a socket contact 10 according to one embodiment of the present invention, a terminal contact 11 and an elastic contact 12 are formed separately in this embodiment, though these component elements may be formed into an integral unit.

The terminal contact 11 has a contact portion 11*a* for holding a core wire of a cable to be inserted while being in contact with a side part of the core wire, and a connector 11*d* provided behind the contact portion 11*a* to establish connection with an electric circuit board and other electric devices.

The connector 11*d* extends from the rear of the contact portion 11*a* in such a manner that it is folded at a substantially right angle in this embodiment, but may take another form.

The contact portion 11*a* has a pair of regulators 11*b* and 11*c* folded and erected on both sides of the contact portion 11*a* in a width direction. The pair of regulators 11*b* and 11*c* and the contact portion 11*a* form a recessed portion in which a core wire 2 is connected.

The regulators 11*b* and 11*c* provided on both the sides of the contact portion 11*a* prevent a core wire from widening, when the elastic contact 12 to be described later pushes the core wire from the side opposite to the contact portion 11*a*, thus resulting in good connection stability.

In this embodiment, a to-be-engaged portion 11*e* is formed in the connector 11*d* of the terminal contact 11 by cutting out a part of the connector 11*d*.

The elastic contact 12 is made of an elastic material by press molding or the like.

A retainer 12*b* and a pusher 12*c* are molded in such a manner that they are folded from a plate-like base 12*a* to the side of the contact portion 11*a* of the terminal contact 11.

A tip end portion of the retainer 12*b* faces obliquely rearward. When the core wire 2 tries to move in the direction of being pulled out, the tip end portion of the retainer 12*b* is engaged in a side part of the core wire 2, thus preventing the pullout.

In this embodiment, a guide notch 112*a* in the shape of a triangular pyramid in cross-section is formed in the tip end portion, to thereby facilitate inserting a core wire.

A contact point of the pusher 12*c* is situated between the regulators 11*b* and 11*c* of the terminal contact 11. A tip end portion of the pusher 12*c* is folded back to the side of the base 12*a*, and the pusher 12*c* comes in contact with a side part of the core wire 2 with a curved surface.

In this embodiment, the elastic contact 12 has a housing engagement portion 12*d* that is elastically engaged and stopped in the internal side surface of a housing 20 to be described later at the rear of the base 12*a*, and a terminal engagement portion 12*e* that is engaged and stopped in the to-be-engaged portion 11*e* cut out of the terminal contact 11.

FIGS. 2A to 2C illustrate a procedure for assembling the socket contact into the housing 20 of a terminal board or the like.

As illustrated in FIG. 2A, the housing 20 has grooves into each of which each of the terminal contact 11 and the elastic contact 12 is inserted from the rear side of an insertion opening 21 for the cable 1.

Both the side edges of the base 12*a* of the elastic contact 12 are inserted into opposite grooves 23*b*, which are formed under ledges 23*a* provided at the corners of the side surfaces of the housing 20, and the housing engagement portion 12*d* is lance-engaged in a to-be-engaged portion 24*b* provided in the housing 20.

In this embodiment, a guide recess 24*c* is provided behind the to-be-engaged portion 24*b*, and a recessed portion 24*a* for fitting the housing engagement portion 12*d* therein is formed in front of the projection 24*b*.

Then, as illustrated in FIG. 2B, when both the side edges of the contact portion 11*a* of the terminal contact 11 are inserted into grooves 22*b*, which are formed by ledges 22*a* provided at the corners opposite to the above-described grooves 23*b* inside the housing 20, the terminal engagement portion 12*e* of the elastic contact 12 is lance-engaged in the to-be-engaged portion 11*e* of the terminal contact 11 as illustrated in FIG. 2C, and hence the terminal contact 11 and the elastic contact 12 are engaged with each other.

FIGS. 4A and 4B illustrate the engagement state of the terminal contact 11 and the elastic contact 12.

Figure 5A:
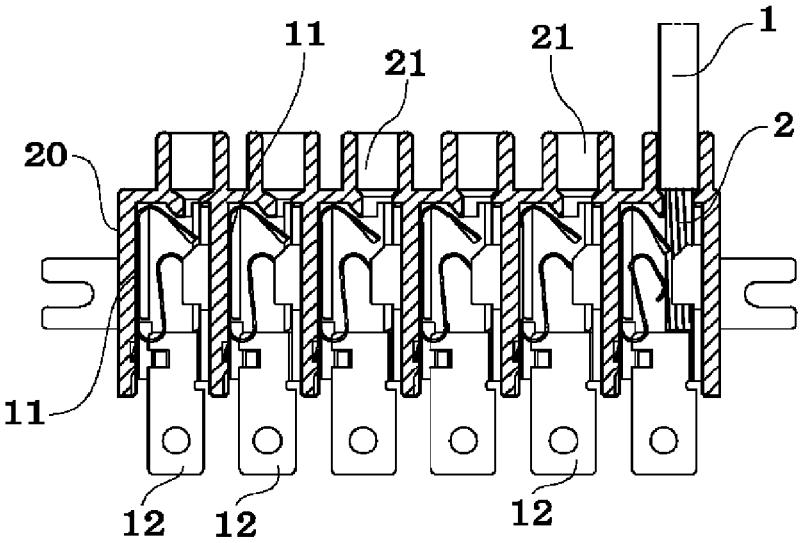
FIG. 5A is a cross-sectional view illustrating the state of fitting the socket contacts in a housing of a terminal board.
Figure 5B:
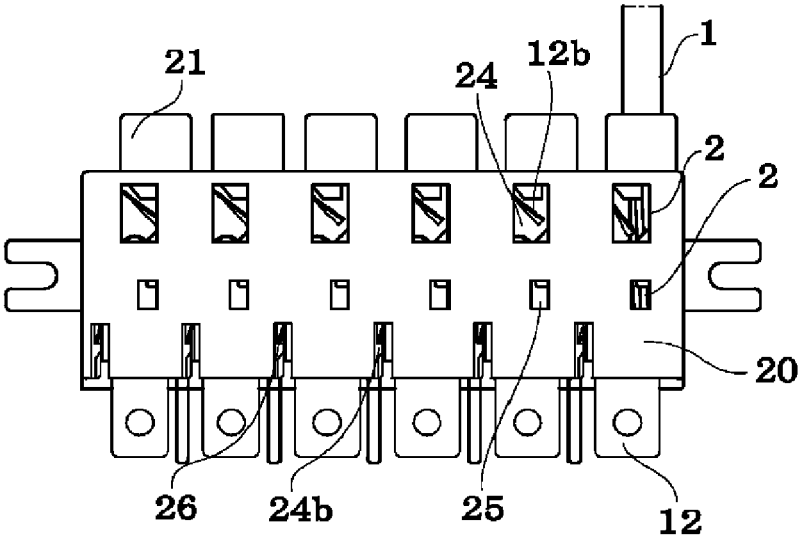
FIG. 5B is an external appearance view of FIG. 5A.

FIGS. 5A and 5B illustrate an example of the terminal board to which the structure of a socket contact according to one embodiment of the present invention is applied.

A plurality of socket contacts are fitted in parallel in the housing 20. The housing 20 has openings 24 through which the retainers 12*b* can be seen, insertion check windows 25 for allowing the insertion of core wires to be checked therethrough, and stopper check windows 26 for allowing the engagement of the housing engagement portions 12*d* to be checked therethrough.

To detach the cable 1, the retainer 12*b* is opened by a tip of a tool such as a screwdriver inserted into the opening 24.

REFERENCE SIGNS LIST

1 cable
2 core wire
10 socket contact
11 terminal contact
11*a* contact portion
11*b* regulator
11*c* regulator
11*d* connector
11*e* to-be-engaged portion
12 elastic contact
12*a* base
12*b* retainer
12*c* pusher
12*d* housing engagement portion
12*e* terminal engagement portion

The invention claimed is:

1. A structure of a socket contact for connecting a core wire of a cable by insertion thereof, the socket contact comprising a terminal contact for establishing electric connection with the core wire, and an elastic contact, wherein the terminal contact has a contact portion for coming in contact with a first side part of the core wire, and regulators that are erected on both sides of the contact portion in a width direction and receive the core wire therebetween to prevent the core wire from widening, the elastic contact has a retainer and a pusher for the core wire that are opposite to the contact portion of the terminal contact, and the pusher has a contact point for coming in contact with the core wire.

2. The structure of a socket contact according to claim 1, wherein:

the terminal contact and the elastic contact are formed separately; and the elastic contact has a housing engagement portion to be engaged in a housing in which the socket contact is fitted, and a terminal engagement portion to be engaged with the terminal contact.

3. The structure of a socket contact according to claim 1, wherein the contact point of the pusher is situated between the regulators of the terminal contact.

4. The structure of a socket contact according to claim 1, wherein the contact point of the pusher comes in contact with a second side part of the core wire opposite to the first side part.

5. The structure of a socket contact according to claim 3, wherein the contact point of the pusher comes in contact with a second side part of the core wire opposite to the first side part.

* * * * *